US007165539B2

(12) United States Patent
Menin et al.

(10) Patent No.: US 7,165,539 B2
(45) Date of Patent: Jan. 23, 2007

(54) INTEGRATED AIR INLET MODULE AND ITS MANUFACTURING PROCESS

(75) Inventors: Denis Menin, Houssen (FR); Laurent Germain, Jeuxey (FR); Jean-Paul Vaudry, Sigolsheim (FR)

(73) Assignee: Mark IV Systemes Moteurs Societe Anonyme, Courbevoie (FR)

( * ) Notice: Subject to any disclaimer, the term of this patent is extended or adjusted under 35 U.S.C. 154(b) by 0 days.

(21) Appl. No.: 11/136,716

(22) Filed: May 25, 2005

(65) Prior Publication Data

US 2005/0263142 A1 Dec. 1, 2005

(30) Foreign Application Priority Data

May 25, 2004 (FR) ..... 04 05657

(51) Int. Cl.
*F02M 25/07* (2006.01)
*F02M 35/10* (2006.01)
*F02B 47/08* (2006.01)

(52) U.S. Cl. ..... 123/568.12; 123/568.17; 123/184.24

(58) Field of Classification Search ..... 123/568.11, 123/568.12, 568.17, 184.21, 184.24, 184.34, 123/184.42, 184.47, 184.61, 563, 568.18; 60/599, 605.2

See application file for complete search history.

(56) References Cited

U.S. PATENT DOCUMENTS 4,134,377 A * 1/1979 Bamsey et al. ..... 123/568.12
4,328,781 A * 5/1982 Morita ..... 123/568.12
5,309,886 A * 5/1994 Hitomi et al. ..... 60/605.2
5,970,960 A * 10/1999 Azuma ..... 123/568.12
6,311,678 B1 11/2001 Lepoutre ..... 123/565.12
6,513,507 B1 * 2/2003 Balekai et al. ..... 123/568.12
2003/0136368 A1 * 7/2003 Ausiello et al. ..... 123/184.21

FOREIGN PATENT DOCUMENTS

| | | |
|---|---|---|
| DE | 101 04 227 C1 | 1/2003 |
| EP | 1 059 435 A | 12/2000 |
| EP | 1 164 280 | 12/2001 |
| EP | 1 319 825 A1 | 6/2003 |
| EP | 1 375 896 | 1/2004 |
| EP | 1 533 512 A12 | 11/2004 |
| WO | WO 2005/024220 A1 | 11/2001 |

* cited by examiner

*Primary Examiner*—Willis R. Wolfe, Jr.
(74) *Attorney, Agent, or Firm*—Berenato, White & Stavish

(57) ABSTRACT

An air inlet module incorporating, in one structural unit, on the one hand, a supply manifold, on the other hand, an exhaust gas reinjection circuit and, finally, a gas/liquid heat exchanger designed to cool the exhaust gases, the module consisting of a sealed assembly of at most four parts, namely, a first part comprising the inlet manifold, the outlet manifolds, a portion of the supply conduit, and a hollow body forming the tank of the exchanger, a second part comprising the many circulation manifolds and a support body for assembling said manifolds in the tank, and a third part of which one portion forms a cover for the hollow open container and comprising several conduit portions forming at least partially the exhaust gas circulation circuit and conveying these gases to the inlet manifold, also incorporated in said third part.

19 Claims, 17 Drawing Sheets

INTEGRATED AIR INLET MODULE AND ITS MANUFACTURING PROCESS

The present invention relates to the field of motor vehicle parts and equipment, more particularly the air inlet systems of the internal combustion engines of such vehicles, and relates to an integrated air inlet module, a motor vehicle comprising such a module and a process for manufacturing such a module.

BACKGROUND OF THE INVENTION

At present, the space available under the engine bonnet of vehicles is ever more restricted, particularly around the engine block, favouring integration of the functions to be achieved in order to reduce size, while continuing to maintain their quality and operational life, on which the reliability of the vehicle's operation depends.

In addition, in terms of the development and manufacture of internal combustion engine vehicles, the present trend is no longer think to in terms of isolated elements, namely components or parts, but in terms of assemblies, units or modules, each fulfilling an overall function or several interdependent elementary functions.

This is the case in particular for the overall air inlet function, whether the air is turbocompressed or not, which usually incorporates the function of admitting fresh air and the function of recycling or reinjecting at least part of the exhaust gases, in a way that can be regulated and controlled.

An air inlet module that combines these two functions normally includes, in one structural unit, on the one hand, an inlet manifold or distributor with a supply conduit, on the other hand, a circuit for the controlled reinjection and mixing of exhaust gases in the fresh air admitted by the manifold and, finally, a gas/liquid heat exchanger designed to cool the exhaust gases before they are mixed with the possibly turbocompressed, air admitted, said exchanger being composed substantially of several exhaust gas circulation manifolds mounted in a hollow container forming a tank and receiving a cooling liquid circulating around said circulation manifolds. Different embodiments of such an air inlet module are already known, but these known embodiments have, however, drawbacks and limitations preventing a satisfactory response to the demands made.

Among these limitations can be mentioned, in particular, the difficulty of manufacture, resulting from the very large number of elementary components to be assembled, sensitivity to vibrations and a not inconsiderable excess weight due to these numerous assemblies, and the resulting large size.

Thus, through document EP-A-1 375 896, a module of the aforementioned type is known, incorporating a plate for distributing, mixing and conveying the different fluid gases (fresh air and exhaust gases), in which circulation channels are provided.

Nevertheless, this module still has numerous assembly zones for the many different constituent parts and is large in size.

SUMMARY OF THE INVENTION

The object of the present invention is, in particular, to overcome the aforementioned drawbacks and limitations, whilst also optimising the materials used in terms of cost.

Accordingly, it relates to an air inlet module of the aforementioned type, characterised in that it consists of a sealed assembly of at most four parts, namely, a first part made of a plastic material comprising the inlet manifold, the outlet manifolds thereof, a portion of the supply conduit opening into said inlet manifold, and a hollow body forming an open container and part of the exchanger tank, a second part comprising the many circulation manifolds and a support body for positioning and assembling said manifolds in the tank to form the exchanger, a third part made of a metallic material of which one portion forms a cover for the hollow open container, comprising a plurality of conduit portions forming at least part of the exhaust gas circulation circuit incorporating, conditionally if applicable, the circulation manifolds conveying the exhaust gases in the inlet manifold or in the conduit supplying said manifold, and a fourth part, optionally formed in a single piece with the first part, made up of a hollow body forming an open container and part of the exchanger tank.

BRIEF DESCRIPTION OF THE DRAWINGS

The invention will be better understood, using the description below, which relates to two preferred embodiments, given as non-limiting examples, and explained with reference to the accompanying diagrammatic drawings, in which.

DETAILED DESCRIPTION OF THE INVENTION

Figure 1:
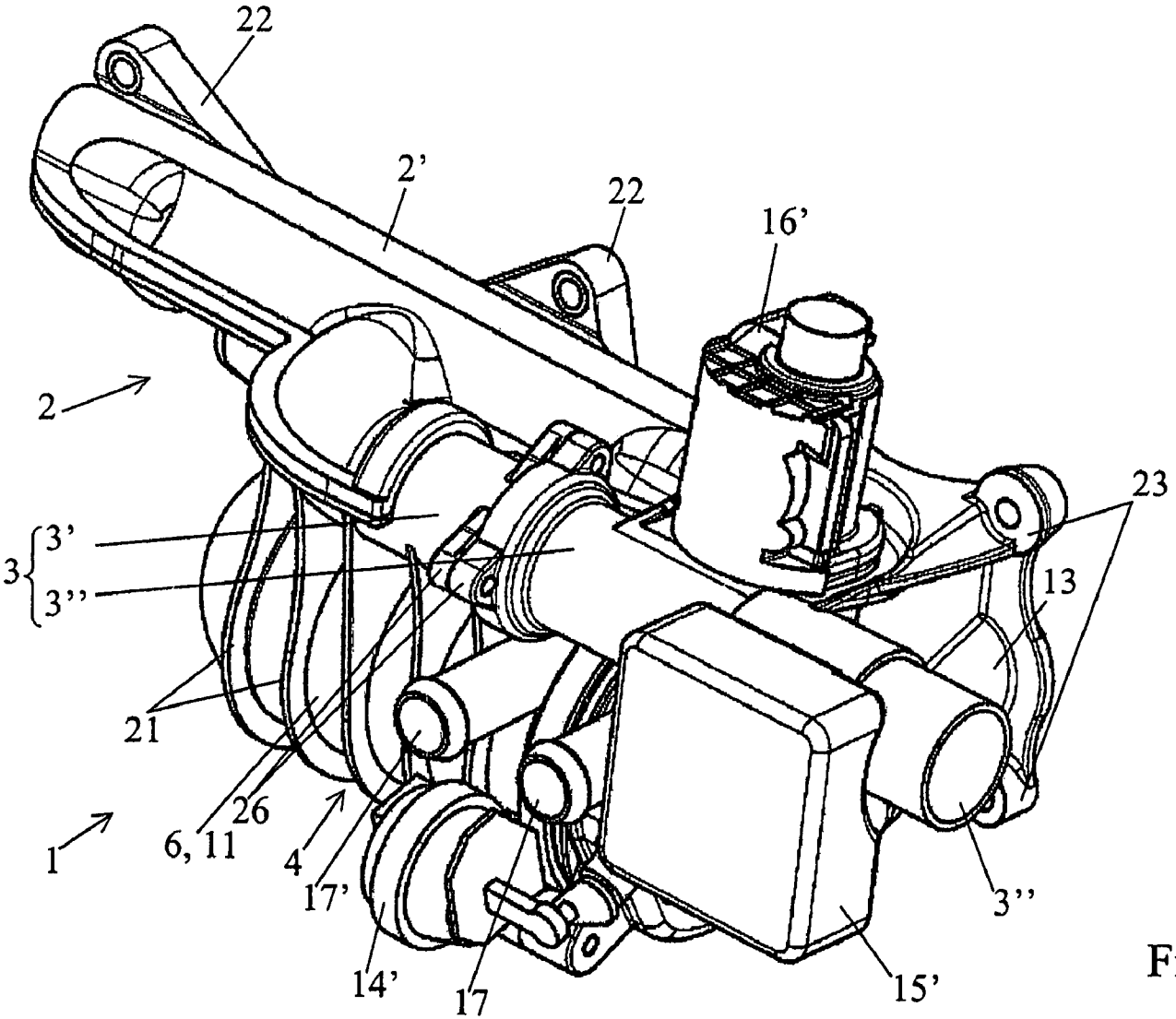
FIGS. 1 to 3 are views in perspective from different angles of an air inlet module according to a first embodiment of the invention, formed by assembling three parts.
Figure 2:
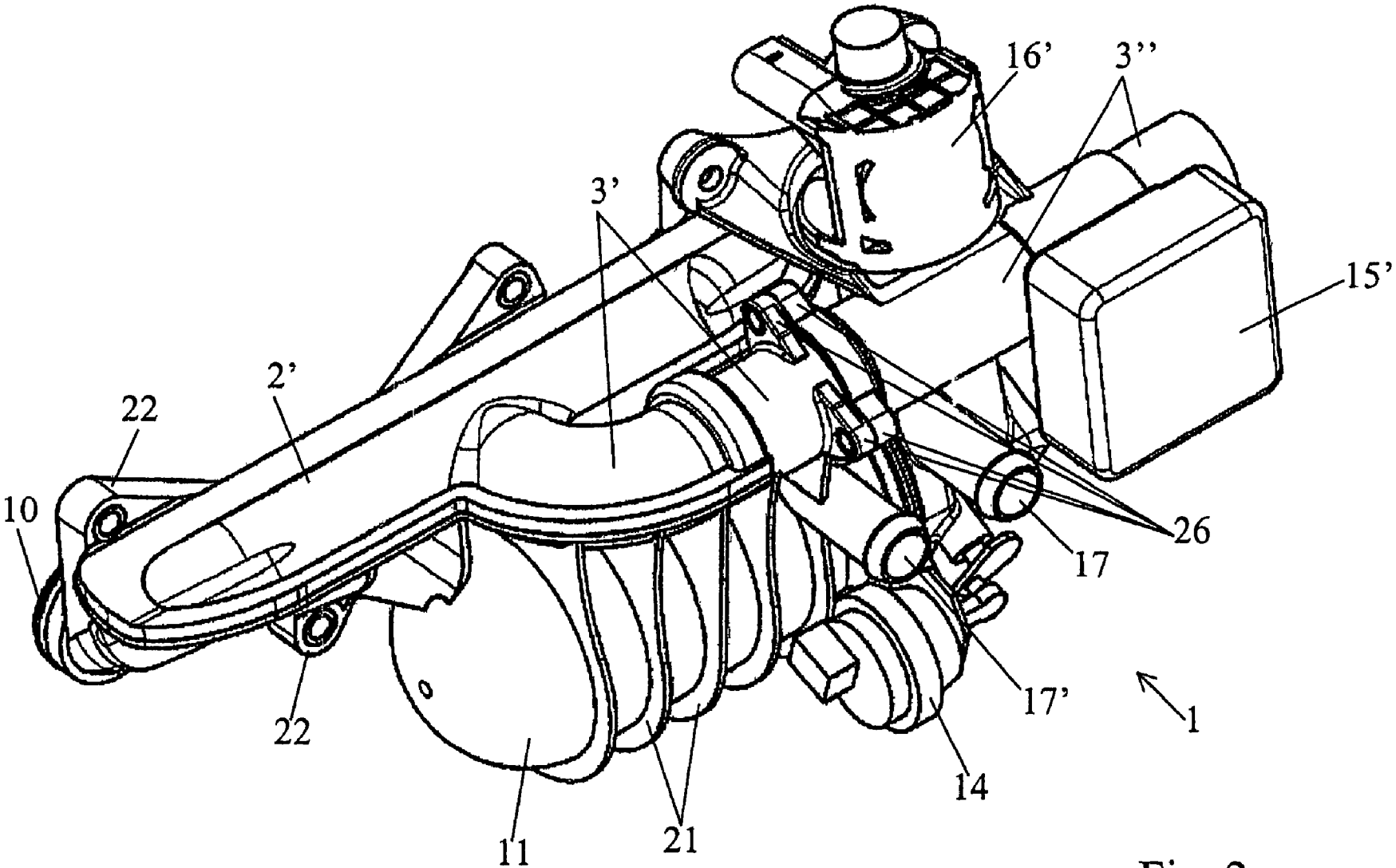
Figure 3:
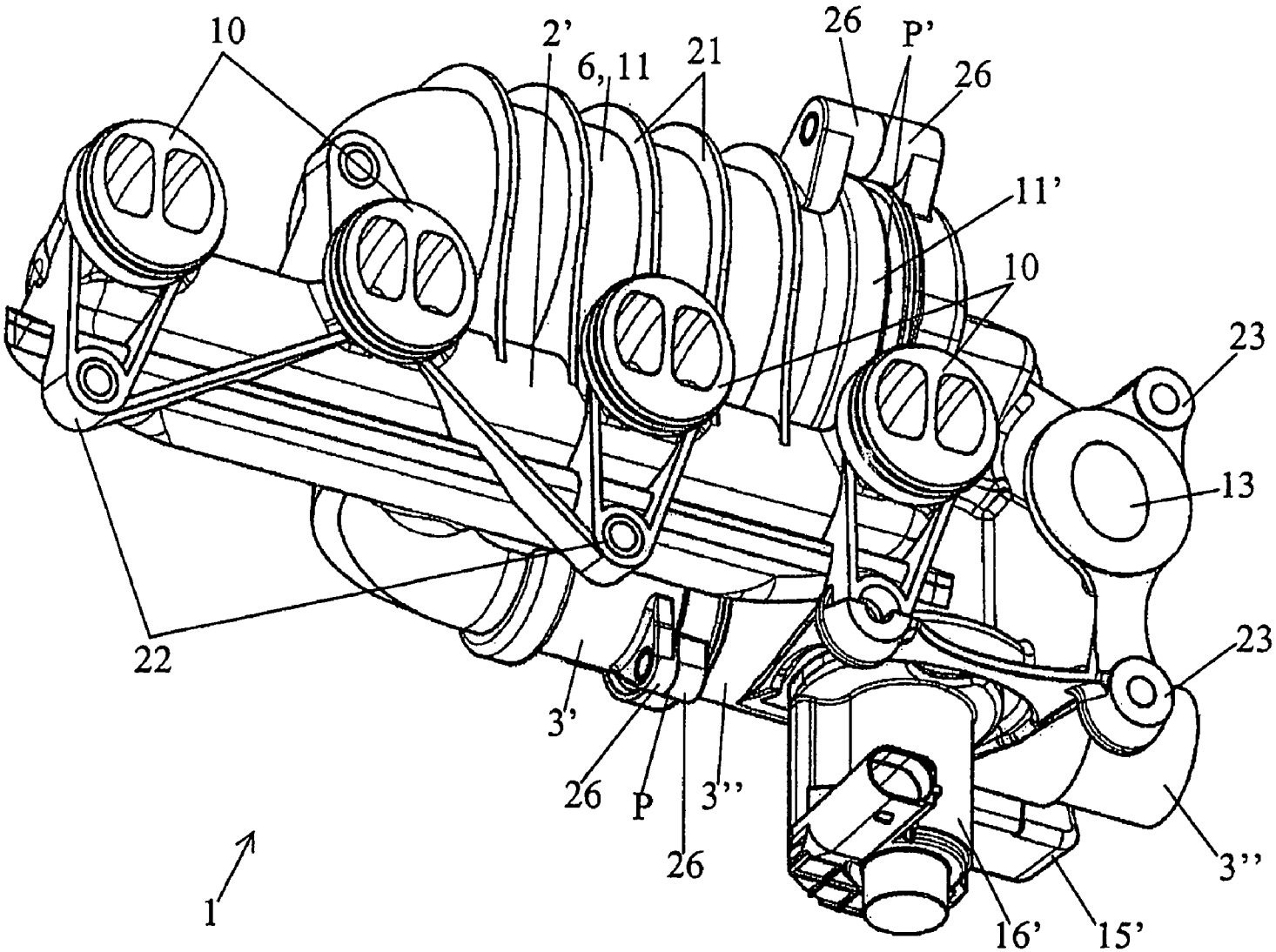
Figure 4:
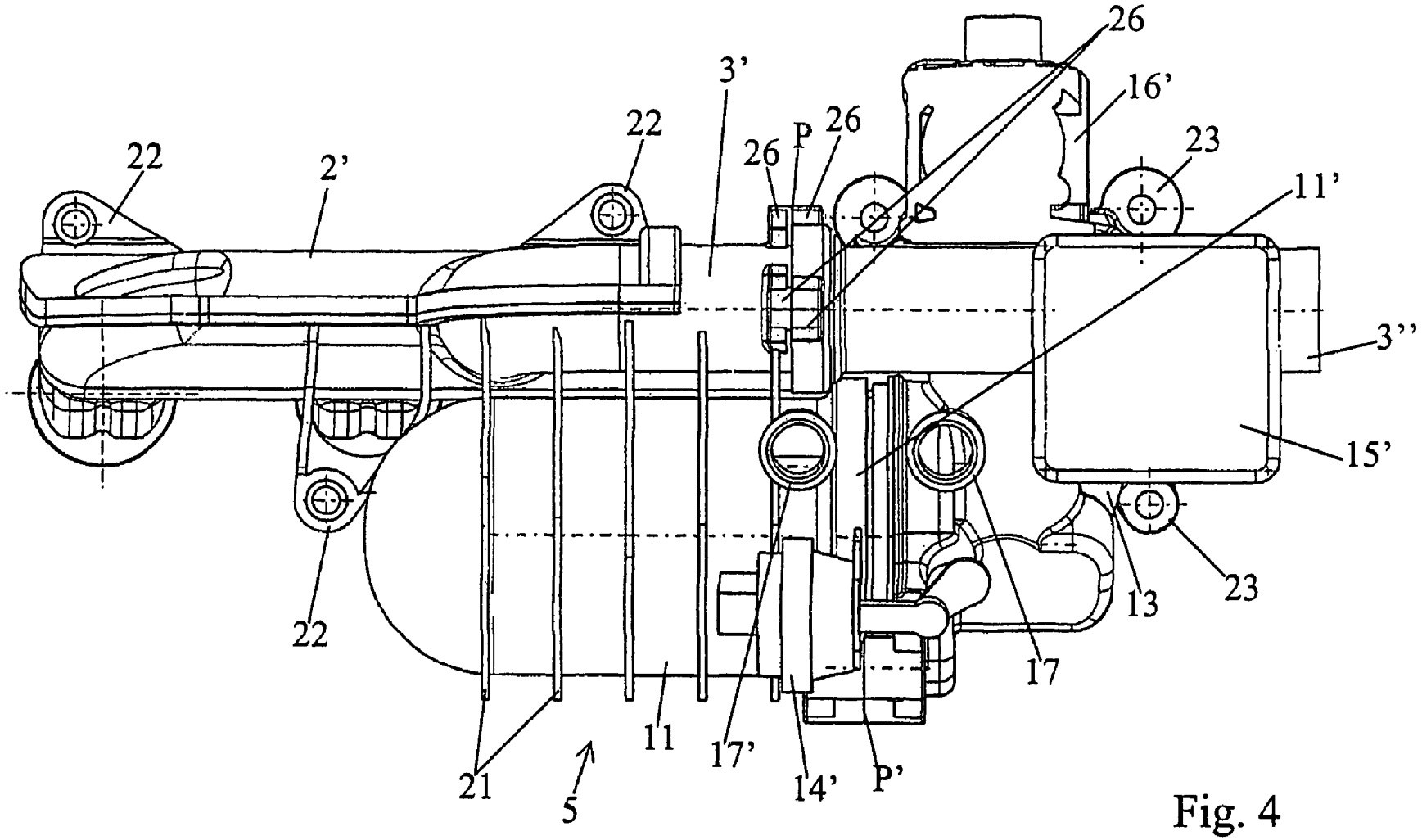
FIGS. 4 to 8 are views in side, front and rear elevation of the module in FIGS. 1 to 3.
Figure 5:
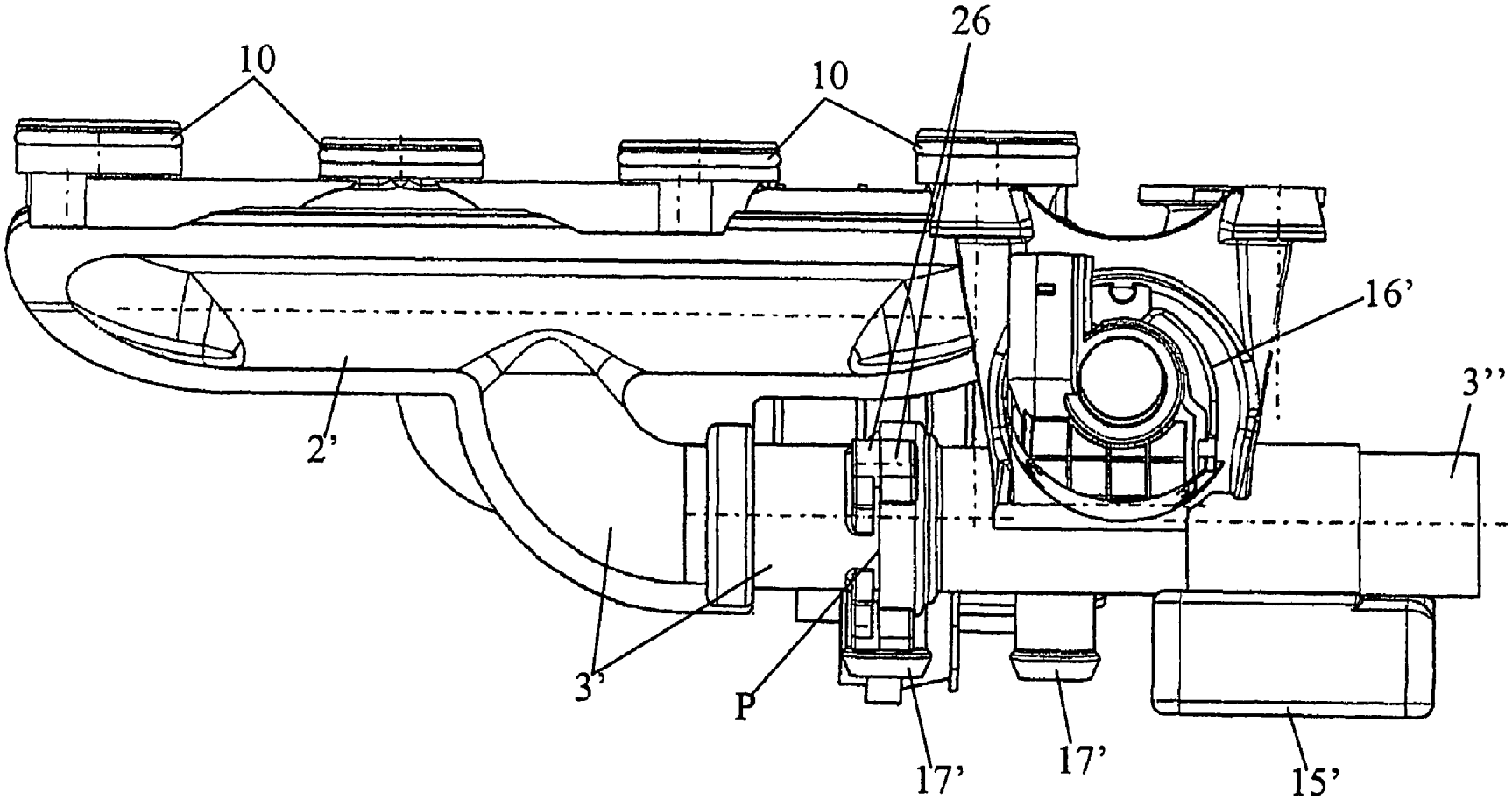
Figure 6:
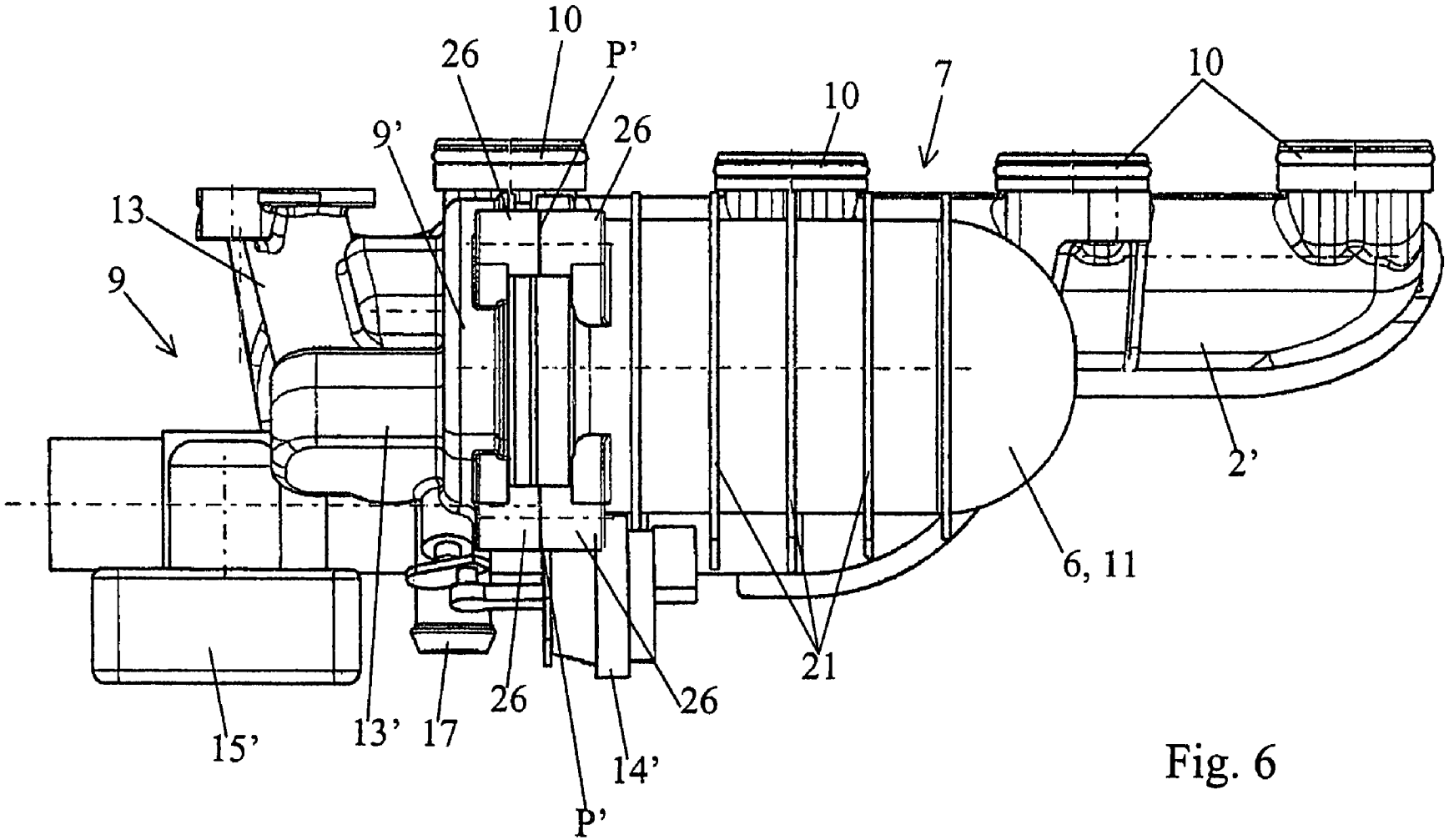
Figure 7:
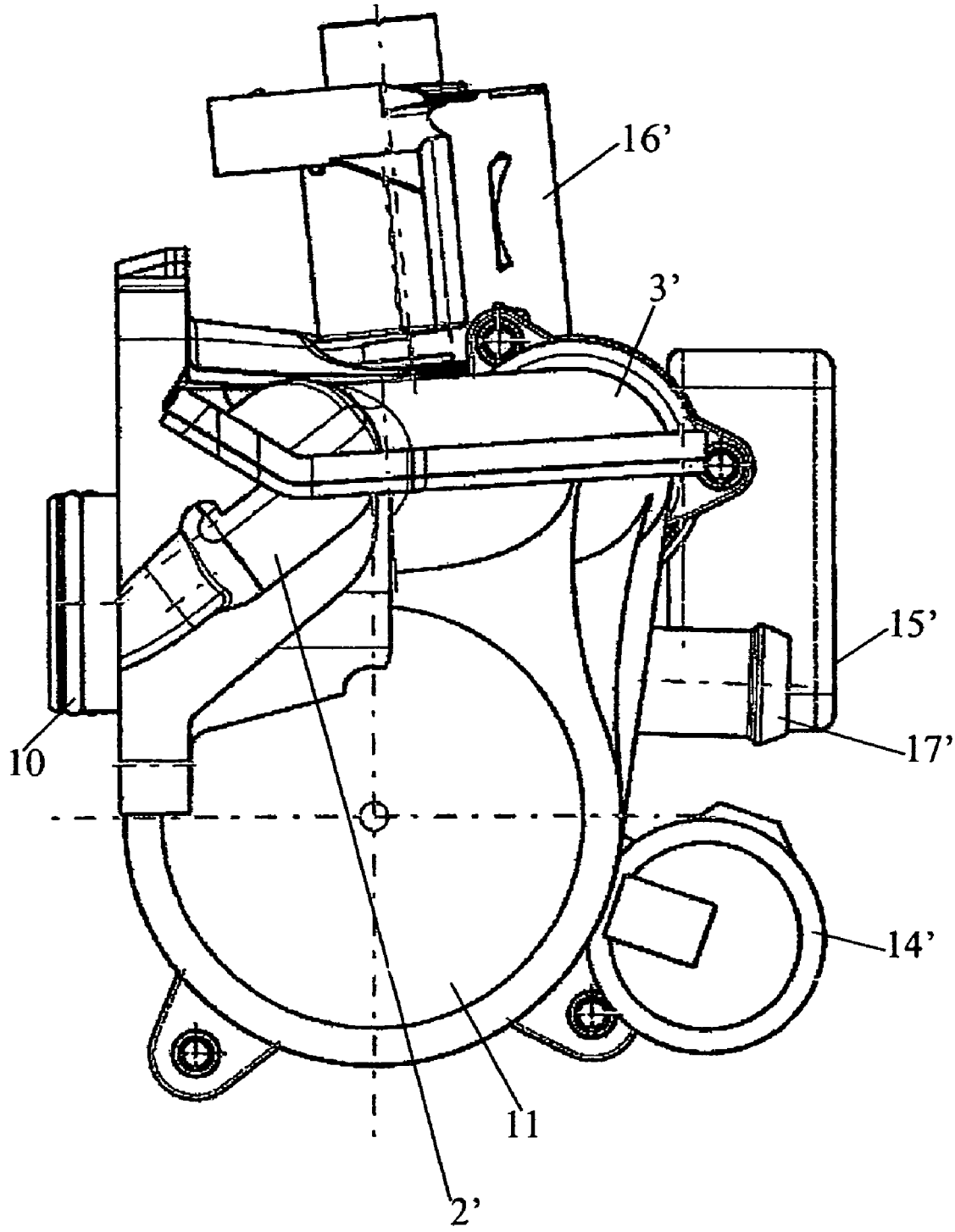
Figure 8:
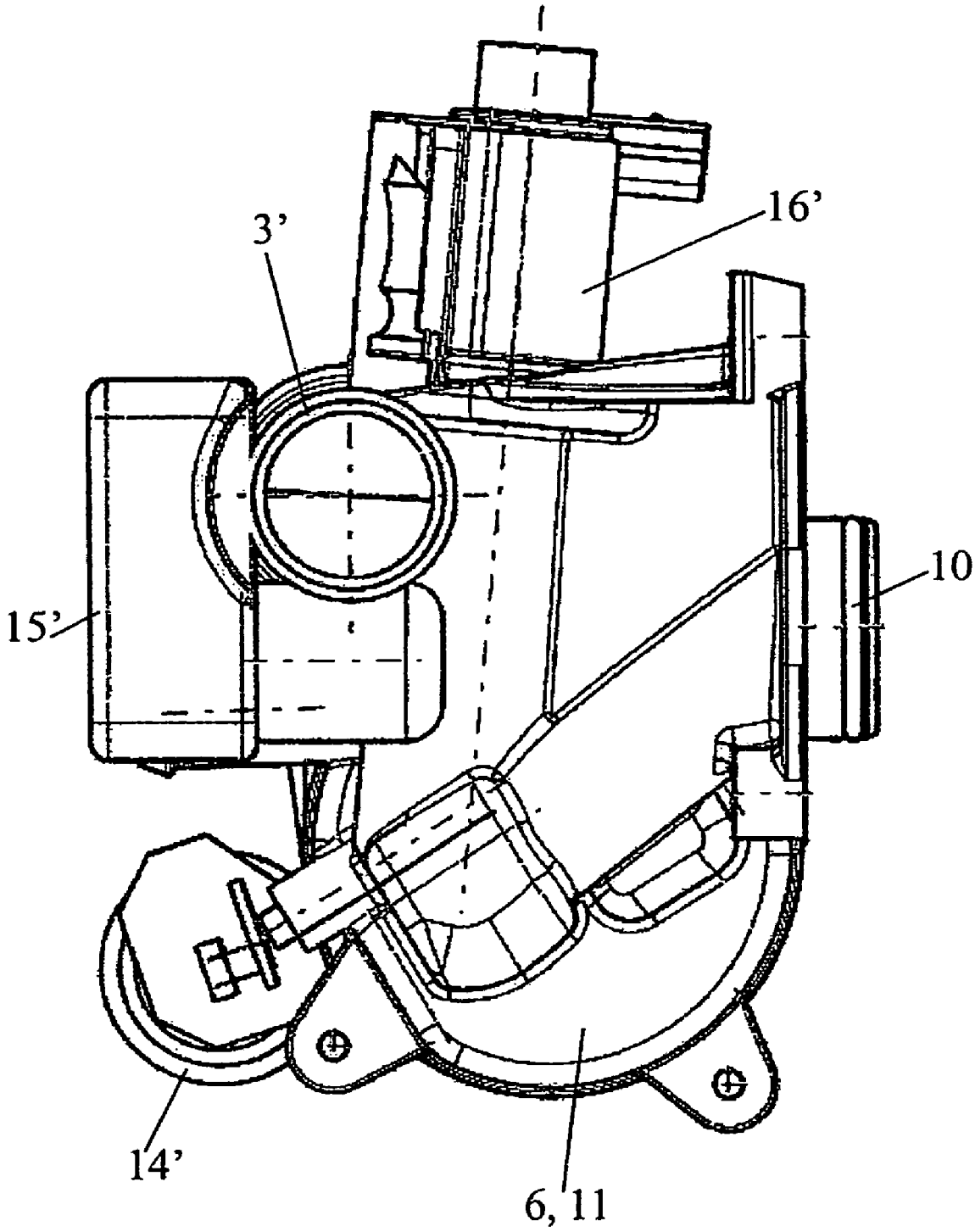

The Figures in the accompanying drawings show an air inlet module 1 incorporating, in one structural unit, on the one hand, an inlet manifold or distributor 2 with a supply conduit 3, on the other hand, a circuit 3", 13, 13', 13", 14, 16 for the controlled reinjection and mixing of exhaust gases in the fresh air aspirated by the manifold 2 and, finally, a gas/liquid heat exchanger 4 designed to cool the exhaust gases before they are mixed with the aspirated fresh, and possibly turbocompressed, air, said exchanger 4 being made up substantially of many exhaust gas circulation manifolds 5 mounted in a hollow container 6 forming a tank and receiving a cooling liquid circulating around said circulation manifolds 5.

According to the invention, this module 1 consists of a sealed assembly of at most four constituent parts 7, 8, 9 and 11, namely, a first part 7 made of a plastic material comprising the inlet manifold 2, the outlet manifolds 10 thereof, a portion 3' of the supply conduit 3 opening into said inlet manifold 2, and a hollow body 11 forming an open container and part of the tank 6 of the exchanger 4, a second part 8 comprising the large number of circulation manifolds 5 and a support body 12 for positioning and assembling said manifolds 5 in the tank 6 to form the exchanger 4, a third part 9 made of a metallic material of which one portion forms a cover 9' for the hollow open container 11 and comprising a plurality of conduit portions 13, 13', 13" forming at least one part of a circulation circuit for the exhaust gases incorporating, conditionally if applicable, the circulation manifolds 5 and conveying the exhaust gases in the inlet manifold 2 or in the conduit 3 supplying the inlet manifold, and, a fourth part 11, optionally formed in a single piece with the first part 7, made up of a hollow body forming an open container and part of the tank 6 of the exchanger 4.

Thus, the module 1 according to the invention comprises only four parts at most to be assembled, each of these parts being produced previously in one or more operational phases (preferably in one or two), comprising elements, parts or components of several functional assemblies of said module 1 and consisting of a material of optimised cost, while being suited to its function.

The portion forming a cover 9' of the third part 9 will thus close the hollow body 11 (at least on the side concerned) to form the tank 6.

The material forming the first part 7 and the fourth part 11 may consist of a thermoplastic material, optionally reinforced, and this part may be achieved by assembly by vibration welding of a plurality of elementary parts produced by injection moulding.

The material forming the third part 9, and the second part 8, may consist of an alloy based on aluminium or a similar metal resistant to the usual temperatures of exhaust gases.

According to a first embodiment, shown in FIGS. 1 to 17, the air inlet module 1 may be formed by the assembly of only three parts 7, 8 and 9, the fourth part 11 being an integral part and formed in a single piece or preassembled with the first part 7.

Figure 18:
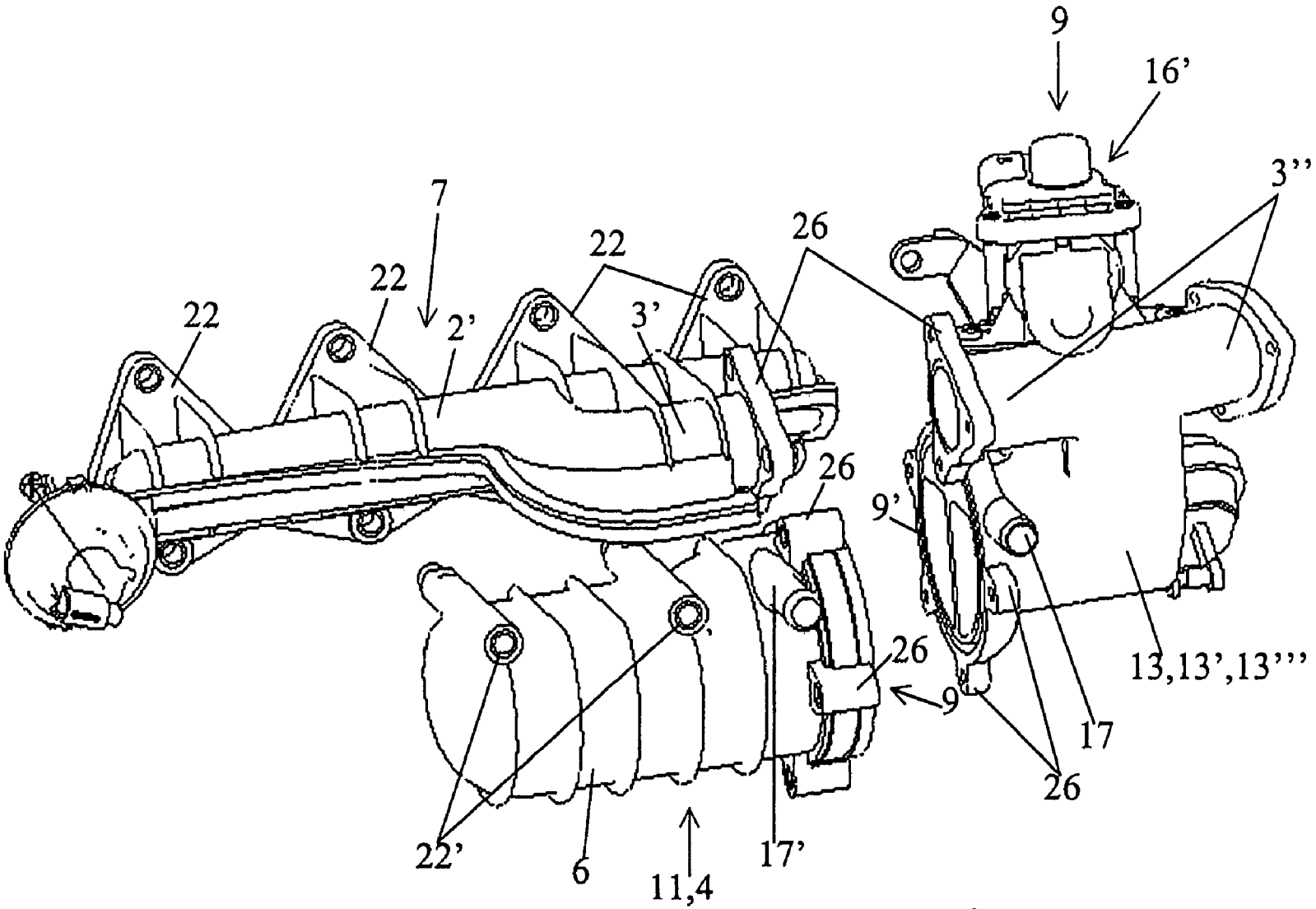
FIG. 18 is an exploded view in perspective of a second embodiment of an air inlet module according to the invention, formed by assembling four parts, and, FIG. 19 is an equivalent fluidics diagram of the inlet module according to the invention.

According to a second embodiment, shown in FIG. 18, the air inlet module 1 may be formed by the assembly of four parts 7, 8, 9 and 11, the fourth part 11 being then independent of the first part.

Apart from this additional separation between the first and fourth parts, in the module according to the second embodiment the composition and structure of its constituent parts are very similar and the forms are substantially identical to the parts forming the module according to the first embodiment.

The description that follows of the elements and components of the different parts therefore applies to both embodiments, unless otherwise indicated.

Advantageously, and in order to achieve an integrated module 1 that is totally functional both regarding its structure and its command and control, the third part 9 may also comprise, mounted on and/or partly in it, on the one hand a component 15 for regulating the throughput of the aspirated air flow and its actuating device 15', and, on the other hand, a component 16 for regulating the quantity of exhaust gas reinjected into the aspirated air, with its actuating device 16', so as to form, together with the circulation circuit 5, 13, 13', 13", the circuit for the controlled reinjection and mixing the exhaust gas/aspirated air.

According to a characteristic of the invention that allows the temperature of the exhaust gases to be regulated before they are reinjected, the conduit portions 13, 13', 13" also define a by-pass channel, allowing the flow of exhaust gases to by-pass or short-circuit the circulation manifolds 5, the third part 9 comprises, in addition, an exhaust gas flow by-pass or diversion component 14 of which the position determines the circulation of these gases through the manifolds 5 or through the by-pass channel, the actuating device 14' of this component 14 being preferably also mounted on and/or partially in said third constituent part 9.

According to another characteristic of the invention, the third constituent part 9 may also incorporate an additional portion 3" of the supply conduit 3 opening into the inlet manifold 2, the exhaust gas circulation circuit 5, 13, 13', 13" opening into said additional portion 3", preferably passing or traversing a component 16 regulating the quantity of exhaust gas reinjected into the aspirated air.

Figure 9:
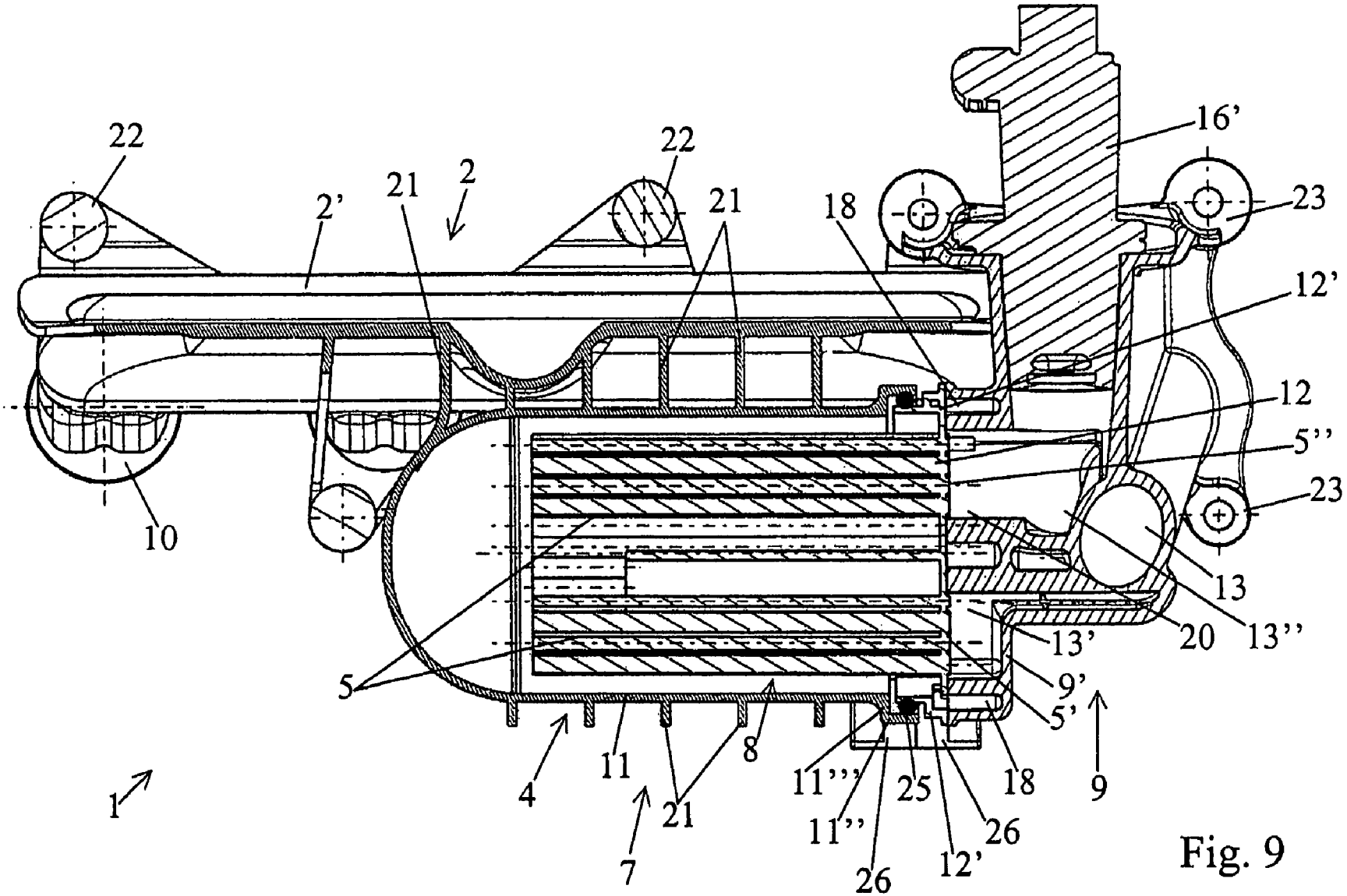
FIGS. 9 and 10 are views in side elevation and in section of the module in FIGS. 1 to 8 in two different planes containing the median axis of the second constituent part of said module.
Figure 10:
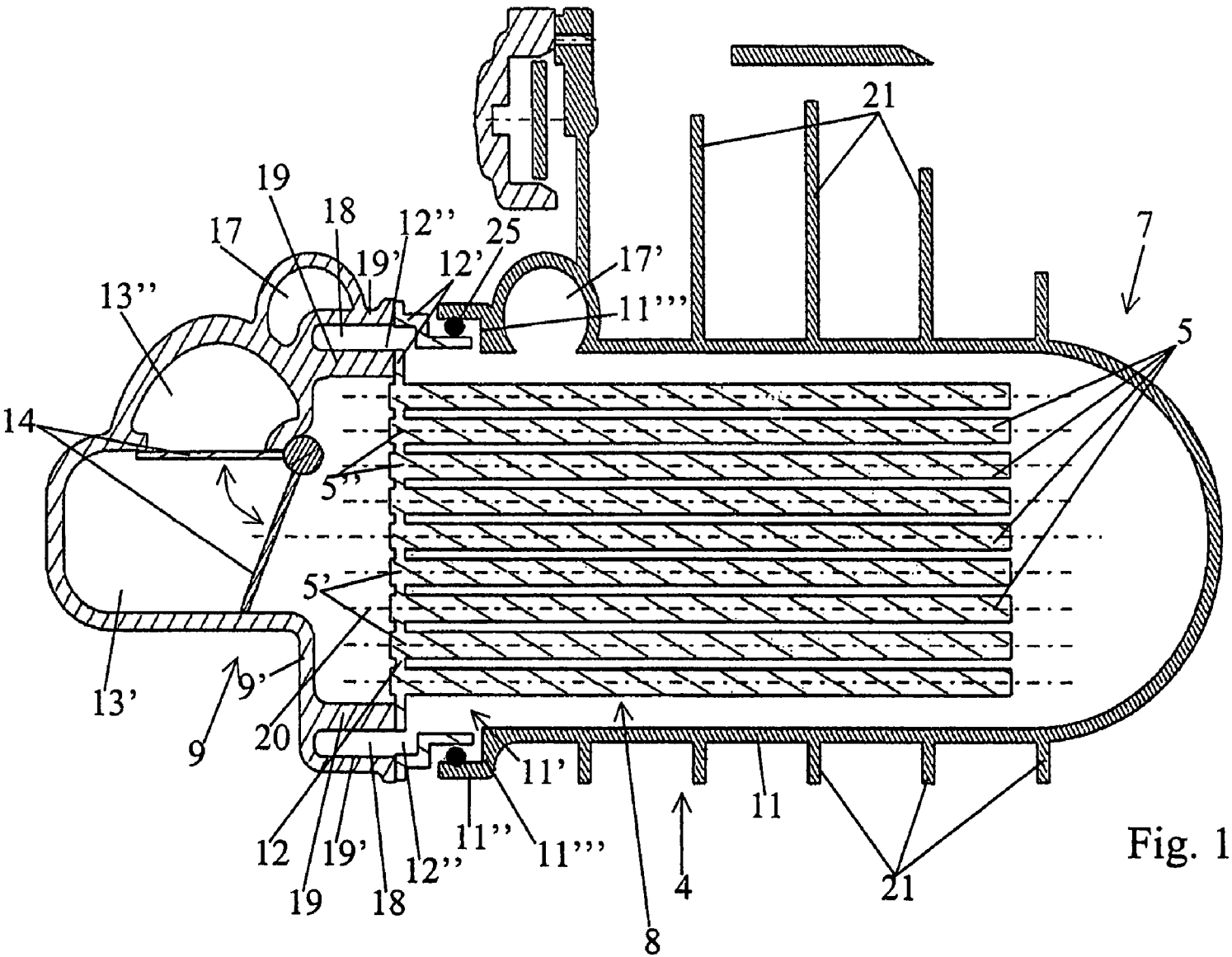
Figure 12:
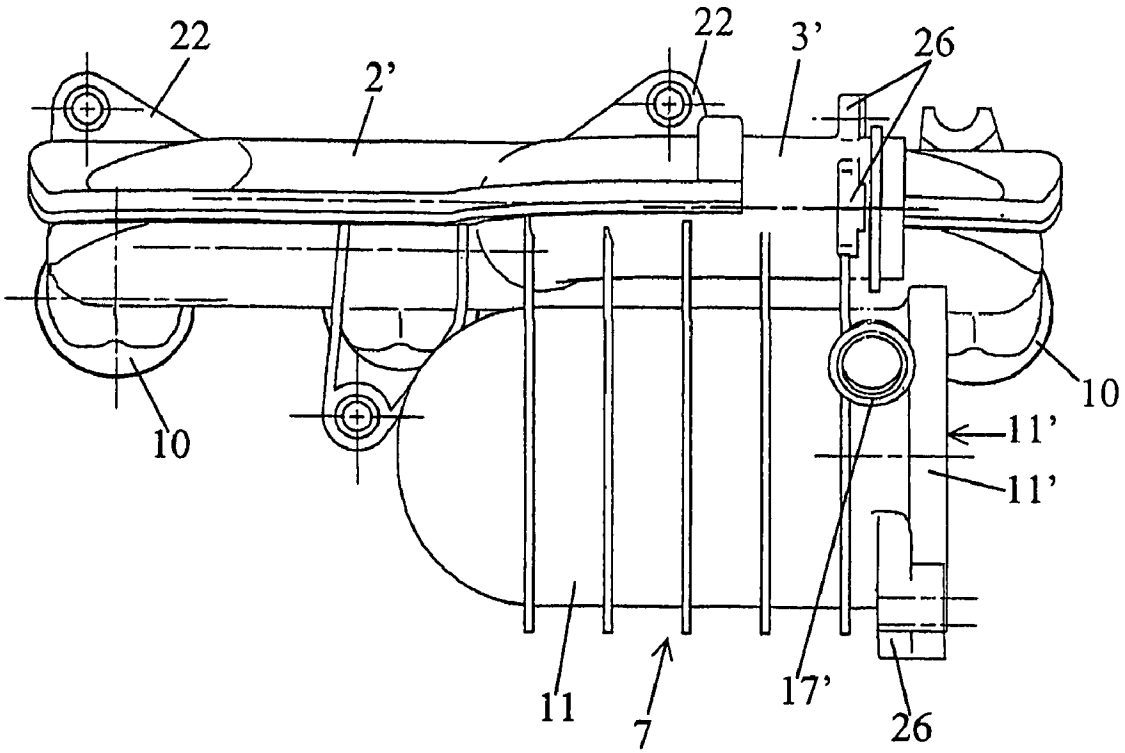
FIGS. 11 and 12 are views in side elevation in two perpendicular directions of the first constituent part of the module in FIGS. 1 to 8.
Figure 11:
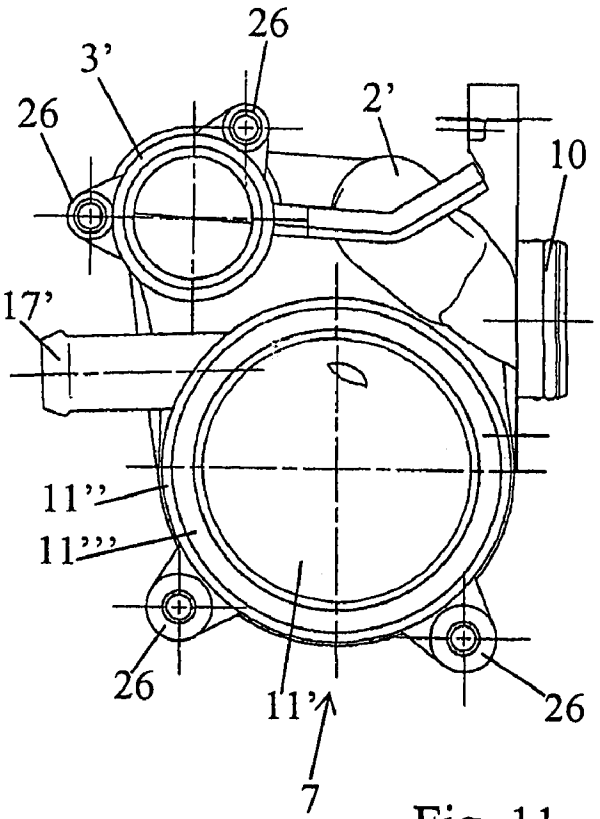
Figure 14:
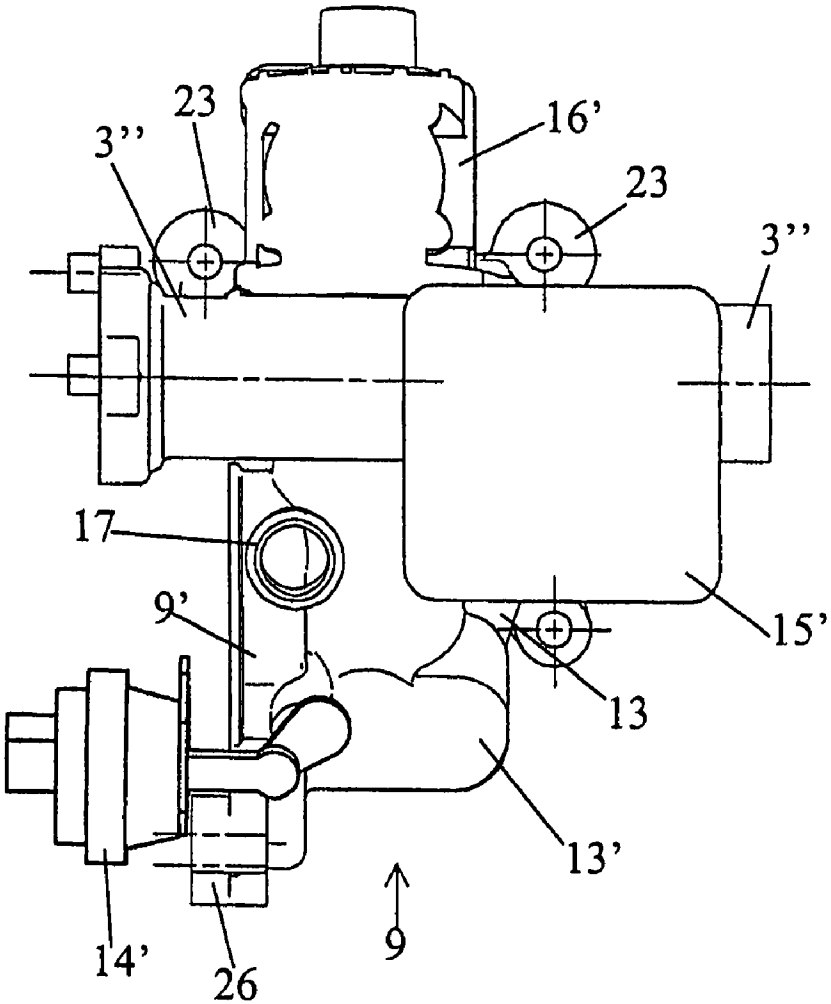
FIGS. 13 and 14 are views, similar to those in FIGS. 11 and 12, of the third constituent part of the module in FIGS. 1 to 8.
Figure 13:
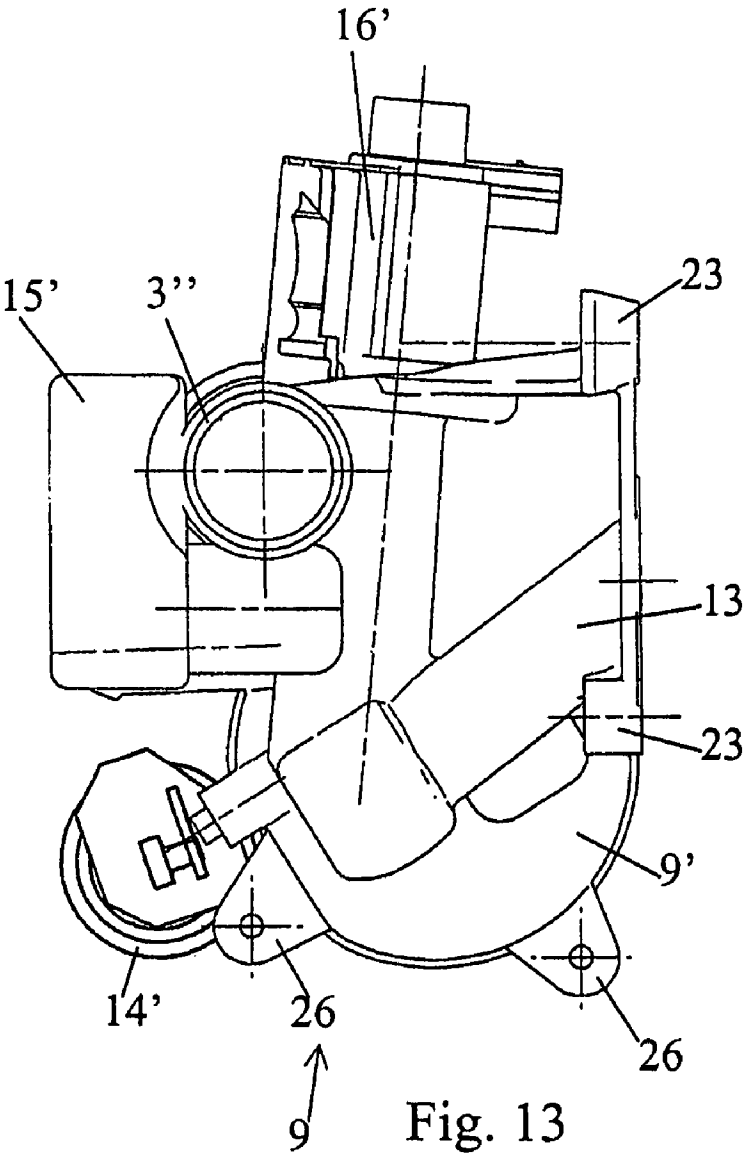
Figure 15:
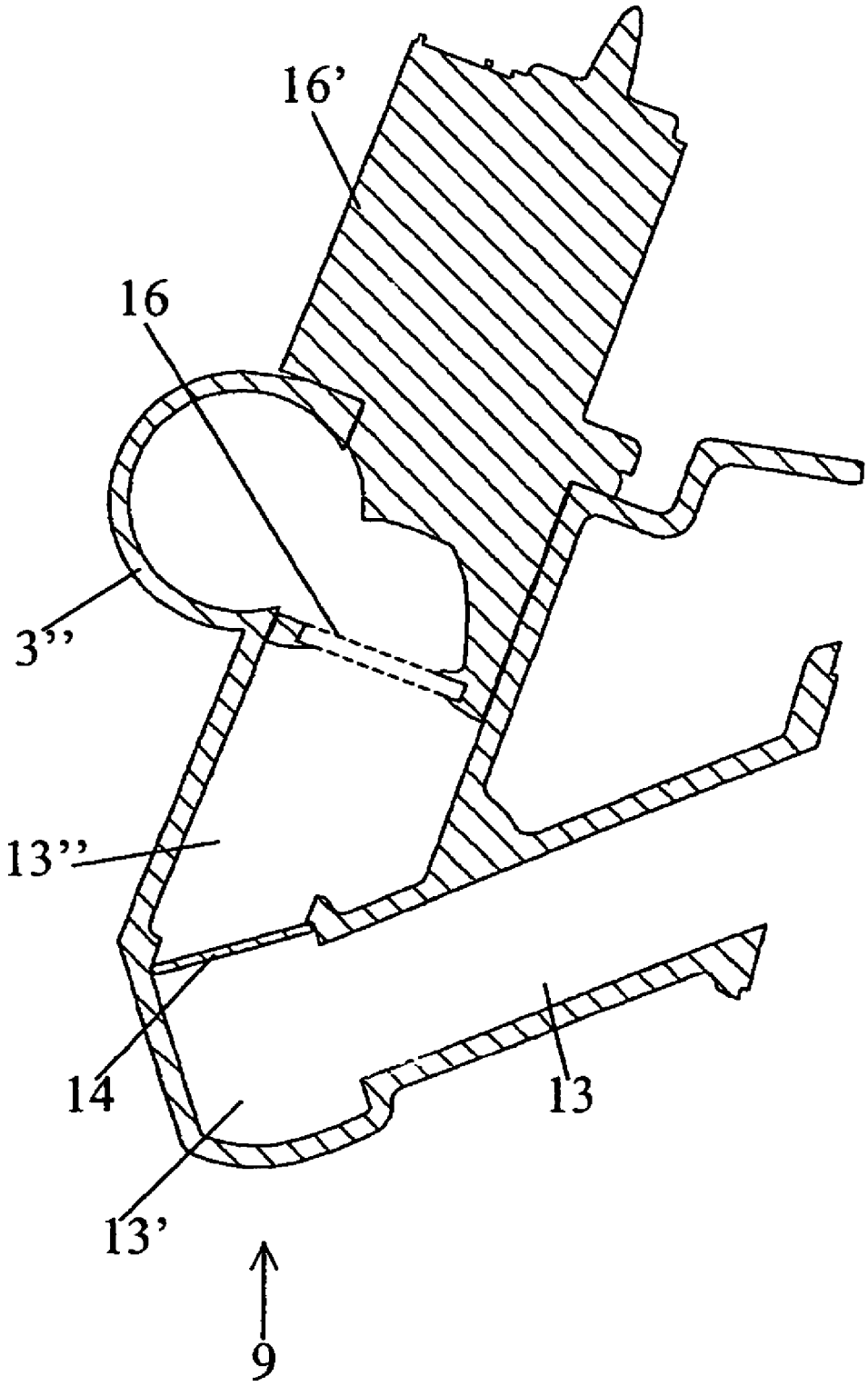
FIGS. 15 and 16 are views in partial section of the basic body of the third constituent part of the module in FIGS. 1 to 8.
Figure 16:
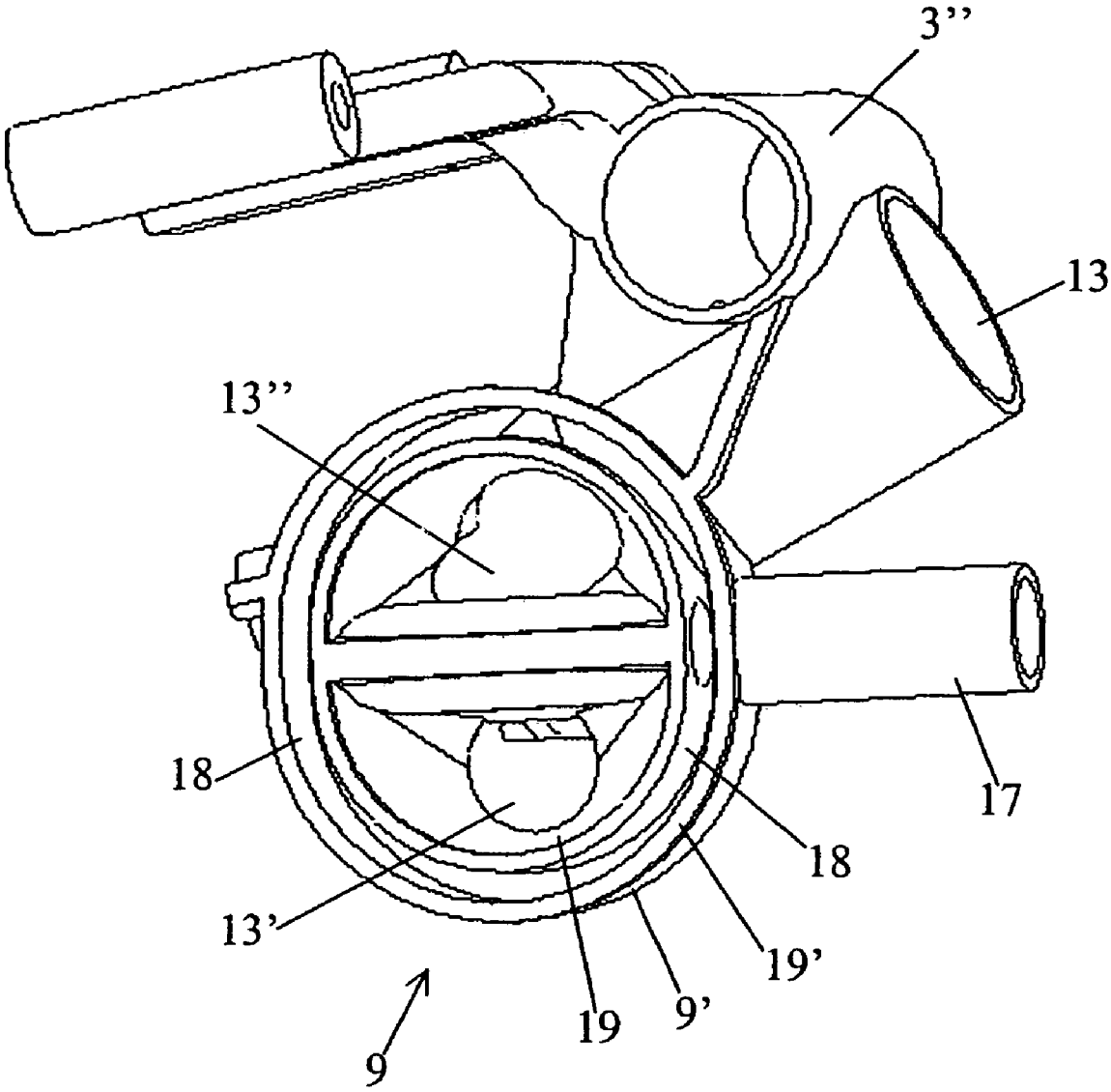
Figure 17:
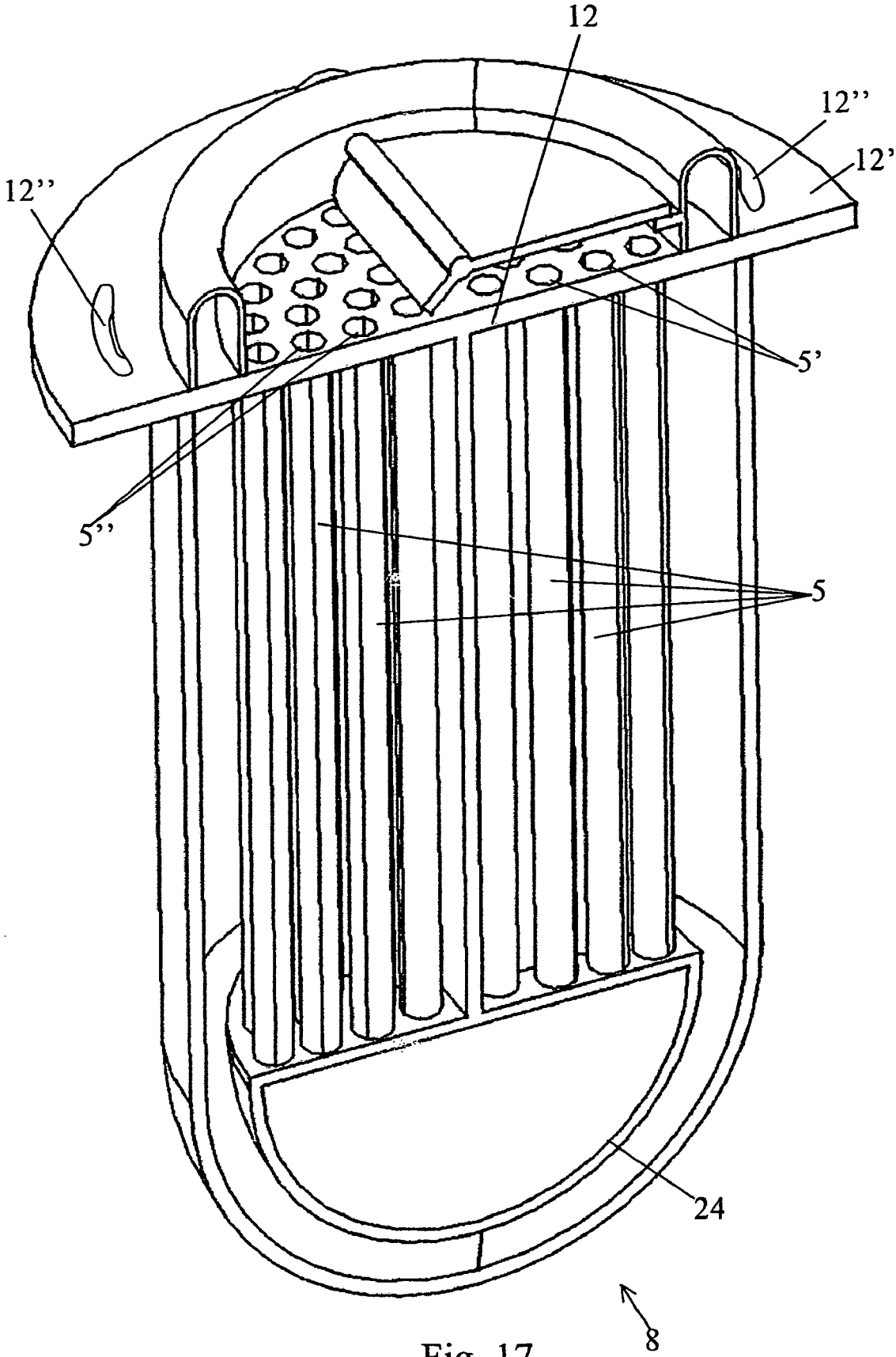
FIG. 17 is a view in perspective and in section of the second part of the module according to the invention, forming an integral part of the heat exchanger.

According to a preferred embodiment of the invention, shown more particularly in FIGS. 9, 10 and 17 of the drawings, the second part 8 consists of a bundle of rigid circulation manifolds 5 connected or formed in a single piece, at one at least of their ends, with the or a support body 12 comprising a peripheral mounting frame 12', this frame 12' being receiveg fitted and sealed in the region of the edge 11" of the opening 11' of the hollow open container 11 and wedged in said opening 11' by the third part 9, said frame 12' being thus sandwiched tight between the fourth part 11, if applicable incorporated with the first part 7, and the third part 9. Thus, in the first embodiment, a single assembly is effectively produced, namely between the first and third parts 7 and 9, for example in the region of opposing grommets or flanges 26 facing and in contact after assembly with the three parts, receiving screws or screw-nut assembly and tightening units.

For the second embodiment, two assemblies must be produced, namely between the first and third parts 7 and 9, on the one hand, and between the fourth and third parts 11 and 9, on the other hand (for example in the region of the opposing grommets or flanges 26).

To reduce their size and make them easier to supply, by grouping the inlet and outlet interfaces geographically, the circulation manifolds 5 advantageously define U-shaped circulation paths and are inserted or formed on a support body 12 of an openwork plate structure with a peripheral mounting frame 12', said openwork plate 12 being exposed to the flow of exhaust gases, when the controlled by-pass component 14 is in a suitable position, such that a looped circulation is established in said manifolds 5 with the inlets and outlets of the circulation paths in the region of said plate 12. The U-shaped structure of the paths may result for example from forming each manifold 5 in a U shape, with its inlet and outlet situated in the region of the openwork plate 12, each in a specific zone thereof grouping together respectively, one, the inlets of the various manifolds 5 and, the other, the outlets thereof.

In a variant, as shown in FIGS. 9, 10 and especially in 17 of the accompanying drawings, the manifolds 5 may consist of rectilinear tube portions of which one end (comprising an orifice forming a circulation inlet or outlet) is integral with the openwork plate 12 and of which the other end opens into an enclosure 24 for closing and stopping-up, establishing a sealed fluidic link between the manifolds 5 provided with an inlet 5' for the exhaust gases and the manifolds 5 equipped with an outlet 5" for these gases (FIG. 17).

The mounting frame 12' may be partially received in a shoulder 11''' formed in the region of the edge 11" of the opening 11' of the hollow open body 11, with a sealing joint 25, for example doughnut-shaped, being interposed.

According to another characteristic of the invention, and as shown in the Figures of the accompanying drawings, more particularly in FIGS. 1, 2, 4, 9 to 14 and 16, the module 1 comprises a cooling liquid circulation circuit for the heat exchanger 4, which consists principally, on the one hand, of an inlet end 17 formed in a single piece with the third part 9, on the other hand, an outlet end 17' formed in a single piece with the first part 7 and opening into the hollow open container 11 forming part of the tank 6 and, finally, a cooling liquid circulation channel 18 arranged in the body forming the third part 9, a channel into which the inlet end 17 opens and which is in fluidic connection with the internal volume of the hollow container 11 forming part of the tank 6, through the support body 12, for example by means of openings 12" arranged in a peripheral mounting frame 12' of said support body 12.

Advantageously, the circulation channel 18 consists of a groove extending peripherally in the region of the face of the third part 9 resting on the peripheral mounting frame 12' of the support body 12 of the second part 8, following the contour of said frame 12' and being situated opposite traversing openings 12" arranged therein, said groove 18 being delimited by two parallel circumferential wall portions 19 and 19' of which the internal wall 19 also delimits the internal volume 20 of the circulation circuit 13, 13', 13" for the exhaust gases in contact with the inlets 5' and the outlets 5" of the circulation manifolds 5 (see FIGS. 9, 10, 16 and 17).

By extending over the peripheral contour of the portion forming a cover, this groove 18 will participate in the cooling of the third part 9, thus limiting dimensional variations due to temperature changes, and in that of the by-pass component 14 directly exposed to the hot exhaust gas flow.

Preferably, the first part 7 and the third part 9 are assembled, in a sealed manner, on the one hand, in the region of the two portions 3' and 3" of the supply conduit 3 opening into the inlet manifold 2 and, on the other hand, in the region of the edge 11" of the opening 11' of the hollow open container 11 and of the portion forming a cover 9', with a peripheral mounting frame 12' of the support body 12 of the second part 8 being interposed between said first and third parts, the assembly planes P and P' of the two assembly zones being parallel to each other, and if applicable merged.

Thus, only two assembly zones are needed to make up the module 1 from the three constituent parts 7, 8 and 9, or from the four constituent parts 7, 8, 9 and 11.

The sealed joining zones between the support body 12 (frame) and the portion forming a cover 9' advantageously have flat surfaces and, in association with the sealed joint between said support body 12 (frame) and the hollow open container 11, allow two fluidic circulation circuits separated in a sealed manner to be formed in this container, one for exhaust gases and the other for the cooling liquid.

According to a practical variation that is advantageous in terms of size in certain configurations, the hollow open container 11 forming part of the exchanger 4 and of the reception tank 6 for the exhaust gas circulation manifolds 5 thereof has a cylindrical, circular-section structure, the inlet manifold 2 having an elongated chamber 2', with the outlet manifolds 10 and the supply conduit 3 opening laterally through opposite longitudinal sides in this chamber 2', and the longitudinal axes of the hollow open container 11, of the chamber 2' of inlet manifold 2 and of a rectilinear part of the supply conduit 3 being substantially parallel.

To confer greater rigidity to the first part 7, provision can be made for the hollow open cylindrical container 11 forming part of the exchanger 4 and incorporated in said part 7 to comprise external ribs 21 to provide rigidity, these ribs 21 being situated in spaced parallel planes substantially perpendicular to the axis of said container 11 and extending to the wall of the chamber 2' of the inlet manifold 2 and to the portion of supply conduit 3' forming part of the first part 7.

To connect the module 1 in situ, fixing flanges 22, formed in a single piece with the first part 7, are associated with outlet manifolds 10 and at least one, preferably several, fixing flange(s) 23, formed in a single piece with the third part 9, is (are) arranged around the inlet of the conduit 13 conveying the exhaust gases in the circulation circuit formed in the third part 9, additional fixing flanges 22' being formed on the fourth part 11, if this fourth part is not structurally incorporated in said first part 7.

The flanges 22' may serve either to connect part 11 to part 7, or to directly connect said part 11 with the support body of the inlet module 1.

The invention also relates to an internal combustion engine vehicle, characterised in that it comprises an air inlet module 1 incorporated as described above, preferably fixed directly on the engine block.

Preferably, the module 1 is connected on the engine block in the region of the first and third parts 7 and 9, with tightening parts of a deformable material being interposed, preferably resiliently, in the region of fixing points between the first part 7 and said engine block.

Finally, the invention also relates to a process for manufacturing an air inlet module 1 of the type described above, characterised in that it consists in manufacturing separately the first second and third parts 7, 8 and 9, in introducing and adjusting the second part 8 in the first part 7, in such a way that the support body 12 rests peripherally on and partly in the edge 11" of the opening 11' of the hollow open container 11 and positions the second part 8 in this container 11, and then in assembling with a tightened seal the third part 9 with the first part 7 in the region of the two portions 3' and 3" of the supply conduit 3 and in the region of the opening 11' of the hollow open container 11, with the support body 12 being interposed and pinched and the hollow open container 11 being closed and sealed with the portion forming a cover 9'.

In a variant, and according to the second embodiment of the inlet module, the aforementioned process may also consist in manufacturing separately the first, second, third and fourth parts 7, 8, 9 and 11, introducing and adjusting the second part 8 in the fourth part 11, in such a way that the support body 12 rests peripherally on and partially in the edge 11" of the opening 11' of the hollow open container 11 and positions the second part 8 in this container 11, and then in assembling with a tight seal the third part 9, on the one hand, with the first part 7 in the region of two portions 3' and 3" forming the supply conduit 3 and, on the other hand, with the fourth part 11 in the region of the opening 11' of the hollow open container 11, with the support body 12 being interposed and pinched and the hollow open container 11 being sealed and closed with the portion forming a cover 9'.

Preferably, provision can be made to supply a third part 9 comprising, mounted on it and/or partially in it, on the one hand, a component 15 for regulating the throughput of the aspirated air flow and its actuating device 15', on the other hand, a component 16 for regulating the quantity of exhaust gas reinjected in the aspirated air, with its actuating device 16', so as to form, together with the circulation circuit 5, 13, 13', 13", the controlled reinjection and mixing circuit and, finally, the actuating device 14' of the exhaust gas flow by-pass component 14.

The base body of this third part 9, forming in particular, with the manifolds 5, a two-way circulation circuit (a cooled way passing through the manifolds 5 and a non-cooled way short-circuiting these manifolds), that can be selected with the by-pass component 14, is achieved advantageously by moulding.

This base body comprises substantially, as is shown in FIGS. 13 to 16, a conduit portion or end 13 for conveying exhaust gases, a contiguous conduit portion 13' conveying said gases to the inlets 5' of the manifolds 5 in a portion forming a cover 9' and defining a volume 20, and, finally, a conduit portion 13" conveying the cooled gases from the outlets 5" of the manifolds 5 to the conduit portion 3" through a passage controlled by the regulating component 16.

Figure 19:
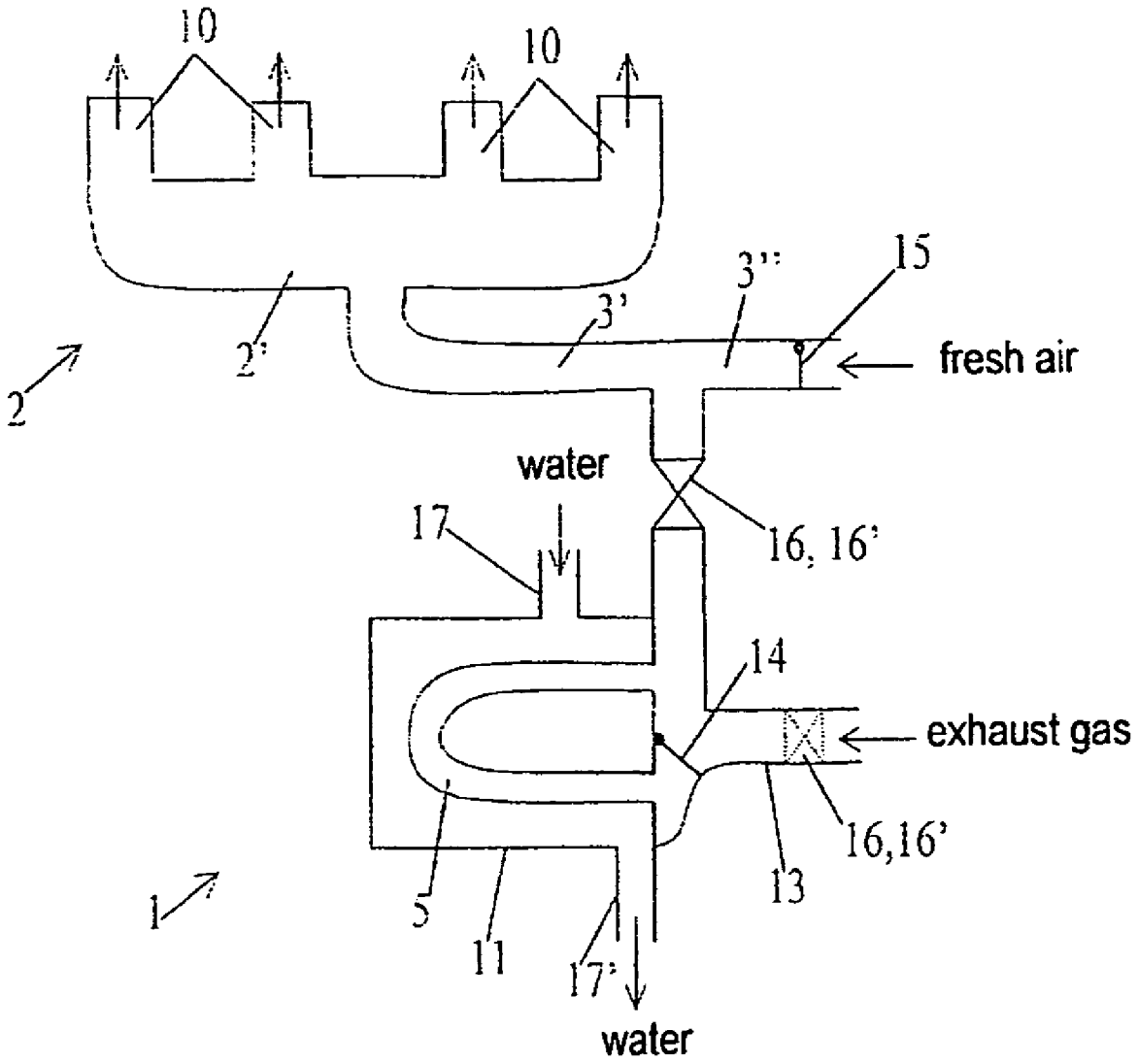

FIG. 19 illustrates two possibilities for mounting the regulation component 16 (and its actuating device 16'), namely, either downstream of the component 14 (shown in unbroken lines—in relation to the first embodiment), or upstream of said component 14 (shown in dotted lines—in relation to the second embodiment).

Of course, the invention is not limited to the embodiments described and illustrated in the accompanying drawings. Modifications are possible, particularly from the point of view of the composition of the various elements or by substitution of technical equivalents, without thereby departing from the protective scope of the invention.

The invention claimed is:

1. Air inlet module incorporating, in one structural unit, on the one hand, an inlet manifold or distributor with a supply conduit, on the other hand, a circuit for the controlled reinjection and mixing of exhaust gases in the fresh air admitted by the inlet manifold and, finally, a gas/liquid heat exchanger designed to cool the exhaust gases before they are mixed with the optionally turbocompressed, air admitted, said exchanger being composed substantially of several exhaust gas circulation manifolds mounted in a hollow container forming a tank and receiving a cooling liquid circulating around said circulation manifolds, the module comprising a sealed assembly of at most four parts, namely, a first part made of a plastic material comprising the inlet manifold, the outlet manifolds thereof, a portion of the supply conduit opening into said inlet manifold, a second part comprising the many circulation manifolds and a support body for positioning and assembling said manifolds in the tank to form the exchanger, a third part made of a metallic material of which one portion forms a cover for the hollow open container and comprising a plurality of conduit portions forming at least part of an exhaust gas circulation circuit incorporating the circulation manifolds and conveying the exhaust gases in the inlet manifold or in the conduit supplying said manifold, and a fourth part made up of a hollow body forming an open container and part of the tank of the exchanger, the conduit portions also defining a bypass channel, allowing the flow of exhaust gases to bypass or short-circuit the circulation manifolds; the third part comprising, in addition, an exhaust gas flow by-pass or diversion component of which the position determines the circulation of these gases through the manifolds or through the by-pass channel, the actuating device of this component being also mounted on said third constituent part.

2. An air inlet module as claimed in claim 1, wherein the fourth part, is formed in a single piece with the first part.

3. An air inlet module as claimed in claim 1, wherein an actuating device of said component is also mounted on said third constituent part.

4. Air inlet module incorporating, in one structural unit, on the one hand, an inlet manifold or distributor with a supply conduit, on the other hand, a circuit for the controlled reinjection and mixing of exhaust gases in the fresh air admitted by the inlet manifold and, finally, a gas/liquid heat exchanger designed to cool the exhaust gases before they are mixed with the optionally turbocompressed, air admitted, said exchanger being composed substantially of several exhaust gas circulation manifolds mounted in a hollow container forming a tank and receiving a cooling liquid circulating around said, the module comprising a sealed assembly of at most four parts, namely, a first part made of a plastic material comprising the inlet manifold the outlet manifolds thereof, a portion of the supply conduit opening into said inlet manifold, a second part comprising the many circulation manifolds and a support body for positioning and assembling said manifolds in the tank to form the exchanger, a third part made of a metallic material of which one portion forms a cover for the hollow open container and comprising a plurality of conduit portions forming at least part of an exhaust gas circulation circuit conveying the exhaust gases in the inlet manifold or in the conduit supplying said manifold, and a fourth part made up of a hollow body forming an open container and part of the tank of the exchanger the conduit portions also defining a by-pass channel, allowing the flow of exhaust gases to by-pass or short-circuit the circulation manifolds; the third part comprising, in addition, an exhaust gas flow bypass or diversion component of which the position determines the circulation of these gases through the manifolds or through the by-pass channel.

5. Module according to claim 4, characterised in that the third part also comprises, mounted on and/or partly in it, on the one hand a component for regulating the throughput of the aspirated air flow and its actuating device and, on the other hind, a component for regulating the quantity of exhaust gas reinjected into the aspirated air, with its actuating device so as to form, together with the circulation circuit the circuit for the controlled reinjection and mixing the exhaust gas/aspirated air.

6. Module according to claim 4, characterised in that the third constituent part also incorporates an additional portion of the supply conduit opening into the inlet manifold the exhaust gas circulation circuit opening into said additional portion preferably passing or traversing a component regulating the quantity of exhaust gas reinjected into the aspirated air.

7. Module according to claim 4, characterised in that the second part consists of a bundle of rigid circulation manifolds connected or formed in a single piece, at one at least of their ends, with the or a support body comprising a peripheral mounting frame, this frame being received fitted and sealed in the region of the edge of the opening of the hollow open container and wedged in said opening by the third part, said frame being thus sandwiched tight between the fourth part, if applicable incorporated with the first part, and the third part.

8. Module according to claim 4, characterised in that the hollow container is closed at one of its longitudinal ends, its other end being closed by the portion forming a cover to make up a closed tank, and in that the circulation manifolds define U-shaped circulation paths and are inserted or formed on a support body having the structure of an openwork plate with a peripheral mounting frame, said openwork plate being exposed to the flow of exhaust gases, if the controlled by-pass component is in a suitable position, in such a way that a looped circulation is established in said manifolds with the inlets and outlets of the circulation paths in the region of said plate.

9. Module according to claim 4, characterised in that the first part and the third part are assembled, in a sealed manner, on the one hand, in the region of the two portions forming the supply conduit opening into the inlet manifold and, on the other hand, in the region of the edge of the opening of the hollow open container and of the portion forming a cover, with a peripheral mounting frame of the support body of the second part being interposed between said first and third parts, the assembly planes of the two assembly zones being parallel to each other, and if applicable merged.

10. Module according to claim 4, characterised in that the hollow open container, forming part of the exchanger and of the reception tank for the exhaust gas circulation manifolds thereof, has a cylindrical, circularsection structure, in that the inlet manifold has an elongated chamber, with the outlet manifolds and the supply conduit opening laterally through opposite longitudinal sides in this chamber, and in that the longitudinal axes of the hollow open container, of the chamber of inlet manifold and of a rectilinear part of the supply conduit are substantially parallel.

11. Module according to claim 4, characterised in that the hollow open cylindrical container forming part of the exchanger and incorporated in the first part comprises external ribs to provide rigidity, these ribs being situated in spaced parallel planes substantially perpendicular to the axis of said container and extending to the wall of the chamber of the inlet manifold and to the portion of supply conduit forming part of the first part.

12. Module according to claim 4, characterised in that fixing flanges, formed in a single piece with the first part, are associated with outlet manifolds and in that at least one, preferably several, fixing flange(s), formed in a single piece with the third part is (are) arranged around the inlet of the conduit conveying the exhaust gases in the circulation circuit formed in the third part, additional fixing flanges being formed on the fourth part if this fourth part is not structurally incorporated in,said first part.

13. Process for manufacturing an air inlet module according to claim 4, characterised in that it consists in manufacturing separately the first, second and third parts, in introducing and adjusting the second part, in the first part, in such a way that the support body rests peripherally on and partly in the edge of the opening of the hollow open container and positions the second part in this container, and then in assembling with a tightened seal the third part with the first part in the region of the two portions forming the supply conduit and in the region of the opening of the hollow open container, with the support body being interposed and pinched and the hollow open container being closed and sealed with the portion forming a cover.

14. Module according to claim 4, characterised in that it comprises a cooling liquid circulation circuit for the heat exchanger, which consists principally, on the one hand, of an inlet end 17 formed in a single piece with the third part, on the other hand, an outlet end formed in a single piece with the first part and opening into the hollow open container forming part of the tank and, finally, a cooling liquid circulation channel arranged in the body forming the third part channel into which the inlet end opens and which is in fluidic connection with the internal volume of the hollow container forming part of the tank through the support body, for example by means of openings arranged in a peripheral mounting frame of said support body.

15. Module according to claim 14, characterised in that the circulation channel consists of a groove extending peripherally in the region of the face of the third part resting on the peripheral mounting frame of the support body of the second part, following the contour of said frame and being situated opposite traversing openings arranged therein, said groove being delimited by two parallel circumferential wall portions of which the internal wall also delimits the internal volume of the circulation circuit for the exhaust gases in contact with the inlets and the outlets of the circulation manifolds.

16. Internal combustion engine vehicle, characterised in that it comprises an integral air inlet module according to claim 4, preferably fixed directly on the engine block.

17. Vehicle according to claim 16, characterised in that the module is connected on the engine block in the region of the first and third parts, with tightening parts made of a deformable material being interposed, preferably resiliently, in the region of fixing points between the first part and said engine block.

18. Process for manufacturing an air inlet module according to claim 4 characterised in that it consists in manufacturing separately the first, second and third and fourth parts, in introducing and adjusting the second part, in the fourth part in such a way that the support body rests peripherally on and partly in the edge of the opening of the hollow open container and positions the second part in this container, and then in assembling with a tightened seal the third part, on the one hand, with the first part in the region of the two portions forming the supply conduit and, on the other hand, with the fourth part in the region of the opening of the hollow open container, with the support body being interposed and pinched and the hollow open container being closed and sealed with the portion forming a cover.

19. Process according to claim 13, characterised in that it consists in supplying a third part comprising, mounted on it and/or partially in it, on the one hand, a component for regulating the throughput of the aspirated air flow and its actuating device, on the other hand, a component for regulating the quantity of exhaust gas reinjected in the aspirated air, with its actuating device, so as to form, together with the circulation circuit, the controlled reinjection and mixing circuit and, finally, the actuating device of the exhaust gas flow by-pass component.

* * * * *